US009739100B1

(12) United States Patent
Hogan et al.

(10) Patent No.: US 9,739,100 B1
(45) **Date of Patent: *Aug. 22, 2017**

(54) SYSTEMS AND METHODS FOR DIRECTIONAL DRILLING

(71) Applicant: Savant Technologies, LLC, Portland, OR (US)

(72) Inventors: Thomas S. Hogan, Scappoose, OR (US); Michael J. Lachner, Jr., Damascus, OR (US)

(73) Assignee: Savant Technologies, LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/354,662

(22) Filed: Nov. 17, 2016

Related U.S. Application Data

(63) Continuation of application No. 13/800,611, filed on Mar. 13, 2013, now Pat. No. 9,528,321.

(60) Provisional application No. 61/763,398, filed on Feb. 11, 2013, provisional application No. 61/714,356, filed on Oct. 16, 2012.

(51) Int. Cl.

| | |
|---|---|
| ***E21B 17/00*** | (2006.01) |
| ***E21B 47/12*** | (2012.01) |
| ***E21B 7/04*** | (2006.01) |
| ***E21B 47/024*** | (2006.01) |
| *E21B 47/18* | (2012.01) |
| *E21B 17/18* | (2006.01) |

(52) U.S. Cl.
CPC ..... *E21B 17/003* (2013.01); *E21B 7/04* (2013.01); *E21B 47/024* (2013.01); *E21B 47/12* (2013.01); *E21B 17/18* (2013.01); *E21B 47/18* (2013.01)

(58) Field of Classification Search
CPC ..... E21B 17/003; E21B 17/18; E21B 47/024; E21B 47/12; E21B 47/18; E21B 7/04
See application file for complete search history.

(56) References Cited

U.S. PATENT DOCUMENTS

| | | | |
|---|---|---|---|
| 2,557,168 | A | 6/1951 | Arps et al. |
| 4,691,203 | A | 9/1987 | Rubin et al. |
| 5,682,956 | A | 11/1997 | Deken et al. |
| 6,739,413 | B2 | 5/2004 | Sharp et al. |
| 6,776,246 | B1 | 8/2004 | Nickel et al. |
| 6,827,158 | B1 | 12/2004 | Dimitroff et al. |
| 7,013,990 | B1 | 3/2006 | Nickel et al. |

(Continued)

*Primary Examiner* — Robert E Fuller
*Assistant Examiner* — Christopher Sebesta
(74) *Attorney, Agent, or Firm* — Klarquist Sparkman, LLP

(57) ABSTRACT

An underground directional drilling system can comprise a plurality of elongated dual-shaft segments coupled together end-to-end in a drilling string. The segments include an inner shaft that is independently rotable relative to an annular outer shaft, with the inner shafts being coupled together and the outer shafts being coupled together. The plurality of dual-shaft segments can comprise a communication segment that comprises a first electrode, a second electrode, a gap portion between the first and second electrodes that provides electrical insulation therebetween, and an electronic communication controller electrically coupled to the first and second electrodes. The communication controller is configured to generate voltage differences between the electrodes that cause electrical pulses to periodically transfer between the electrodes through the gap portion to wirelessly communicate drilling related data from underground to the surface.

16 Claims, 3 Drawing Sheets

(56) References Cited

U.S. PATENT DOCUMENTS

| | | | |
|---|---|---|---|
| 7,111,693 | B1 | 9/2006 | Self et al. |
| 7,150,331 | B2 | 12/2006 | Cole et al. |
| 7,373,993 | B2 | 5/2008 | Self et al. |
| 7,392,858 | B2 | 7/2008 | Koch et al. |
| 7,510,029 | B2 | 3/2009 | Gunsaulis et al. |
| 7,624,816 | B2 | 12/2009 | Cole et al. |
| 7,654,340 | B2 | 2/2010 | Self et al. |
| 7,663,373 | B1 | 2/2010 | Gard et al. |
| 7,759,824 | B2 | 7/2010 | Gard et al. |
| 7,896,107 | B2 | 3/2011 | Gunsaulis et al. |
| 2007/0247329 | A1 | 10/2007 | Petrovic et al. |
| 2007/0247330 | A1 | 10/2007 | Clark |
| 2011/0000665 | A1 | 1/2011 | Chesnutt |
| 2011/0005838 | A1 | 1/2011 | Granberg et al. |
| 2011/0042144 | A1 | 2/2011 | Downton |
| 2013/0128697 | A1 | 5/2013 | Contant et al. |
| 2014/0102792 | A1 | 4/2014 | Lachner, Jr. et al. |

SYSTEMS AND METHODS FOR DIRECTIONAL DRILLING

CROSS-REFERENCE TO RELATED APPLICATION

This application is a continuation of U.S. patent application Ser. No. 13/800,611, which was filed on Mar. 13, 2013, which claims the benefit of U.S. Provisional Patent Application No. 61/763,398, which was filed on Feb. 11, 2013, and U.S. Provisional Patent Application No. 61/714,356, which was filed on Oct. 16, 2012, all of which are incorporated by reference in their entirety.

FIELD

This disclosure is related to systems and methods for underground directional drilling.

SUMMARY

Directional drilling systems and methods are disclosed herein that include wireless communication technology for transmitting data between an underground location and a surface location. In one example, an underground directional drilling system can comprise a plurality of elongated dual-shaft segments coupled together end-to-end in a drilling string. The segments include an inner shaft that is independently rotable relative to an annular outer shaft, with the inner shafts being coupled together and the outer shafts being coupled together. The plurality of dual-shaft segments includes a communication segment that comprises a first electrode, a second electrode, a gap portion between the first and second electrodes that provides electrical insulation therebetween, and an electronic communication controller electrically coupled to the first and second electrodes. The communication controller is configured to generate voltage differences between the electrodes that cause electrical pulses to periodically transfer between the electrodes through the gap portion to wirelessly communicate drilling related data from underground to the surface.

In some embodiments, the inner shaft and the outer shaft of the communication segment are made of non-magnetic material. In some embodiments, the plurality of dual-shaft segments further comprises at least one non-magnetic dual-shaft segment coupled to a proximal end of the communication segment and at least one non-magnetic dual-shaft segment coupled to a distal end of the communication segment. The non-magnetic segments can enhance the operability of certain sensors or devices in the communication segment that are sensitive to magnetism, such as a compass sensor for determining orientation.

In some embodiments, the communication segment includes an onboard electrical power source, such as batteries, electrically coupled to the communication controller, the electrodes, and/or to other sensors and devices in the communication segment. In some embodiments, most or all of the electrical components of the communication segment are located in the outer shaft, allowing the inner shaft to rotate freely of the electronics.

In some embodiments, the generated electrical pulses from the communication segment are sufficient to communicate drilling-related data to an above ground receiver when the communication segment is located at an underground depth of more than 100 feet, such as at least 150 feet, at least 200 feet, at least 500 feet, at least 1000 feet, at least 5000 feet, at least 10,000 feet, or at least 15,000 feet.

In some embodiments, the communication segment further comprises at least one sensor electrically coupled to the communication controller, such that data from the at least one sensor can be encoded in wireless communications to the surface. The data from the at least one sensor can comprise any of various types, such as one or more of gamma ray data, vibration data, torque data, rotation speed data, pressure data, temperature data, pitch data, yaw data, inclination and azimuth data, etc. In some embodiments, the communication segment can comprise a receiver configured to receive drilling related data from another sensor located in a different segment of the underground directional drilling system, such as from a motor segment adjacent to a drilling head. Such a receiver can comprise an RF receiver configured to wirelessly receive drilling related data from a sensor located in a different segment of the underground directional drilling system. For example, the motor segment can comprise a gyroscopic tool located that wirelessly communicates orientation data to a receiver in the communication segment, which in turn wirelessly communicates the data to the surface.

In some embodiments, a non-magnetic dual-shaft communication segment is coupled between at least one proximal non-magnetic dual-shaft segment and at least one distal non-magnetic dual-shaft segment. A motor segment and drilling head can be coupled just distally to the non-magnetic segments. A plurality of not non-magnetic (e.g., ferrous based material) segments can be positioned at the proximal portion of the drilling string between a drilling rig and the at least one proximal non-magnetic dual-shaft segment.

An exemplary method for directional drilling comprises (1) causing a dual-shaft directional drilling system to drill a first portion of a bore along a first portion of a predetermined bore path through a geologic formation; (2) after the first portion of the bore is drilled, causing a dual-shaft communication segment of the dual-shaft directional drilling system to generate electrical pulses across an electrical insulator at a modulated frequency to wirelessly transmit drilling-related data from an underground location to an above ground location; and (3) causing an adjustment of at least one drilling-related parameter of the dual-shaft directional drilling system based on the received drilling-related data prior to or while drilling a second portion of the bore along a second portion of the determined bore path.

In some embodiments, the causing of the dual-shaft communication segment of the dual-shaft directional drilling system to generate electrical pulses across the electrical insulator can include causing a sufficient voltage difference to be created between a first electrode located on a first side of the electrical insulator and a second electrode located on a second side of the electrical insulator such that an electrical pulse discharges between the electrodes across the insulator.

In some embodiments, the causing of the dual-shaft communication segment of the dual-shaft directional drilling system to generate electrical pulses across the electrical insulator can include modulating the frequency of the pulses to digitally encode drilling related data.

In some embodiments, the drilling-related data comprises orientation data, such as pitch and yaw data, and wherein the causing an adjustment of at least one drilling-related parameter of the dual-shaft directional drilling system comprises causing an adjustment of a drilling direction of the dual-shaft directional drilling system based on the orientation data. In some embodiments, the method can include causing a wireless communication of the orientation data from a sensor in a motor segment of the dual-shaft directional drilling system to the communication segment, the motor segment being distal to and spaced from the communication segment.

In some embodiments, communications of drilling-related data between an underground portion of a drilling string to a surface location can be performed using fluid pulse telemetry, wherein fluctuations in fluid pressure within the drill string are modulated to encode data that is transmitted along the string. The fluid can comprise water, mud, or other fluids, such as within an annular space between the inner shafts and the outer shafts of the dual-shaft drilling string. Fluid pulse telemetry can be used in conjunction with or independently of other communication technologies disclosed herein.

The foregoing and other objects, features, and advantages of the invention will become more apparent from the following detailed description, which proceeds with reference to the accompanying figures.

DETAILED DESCRIPTION

Figure 1:
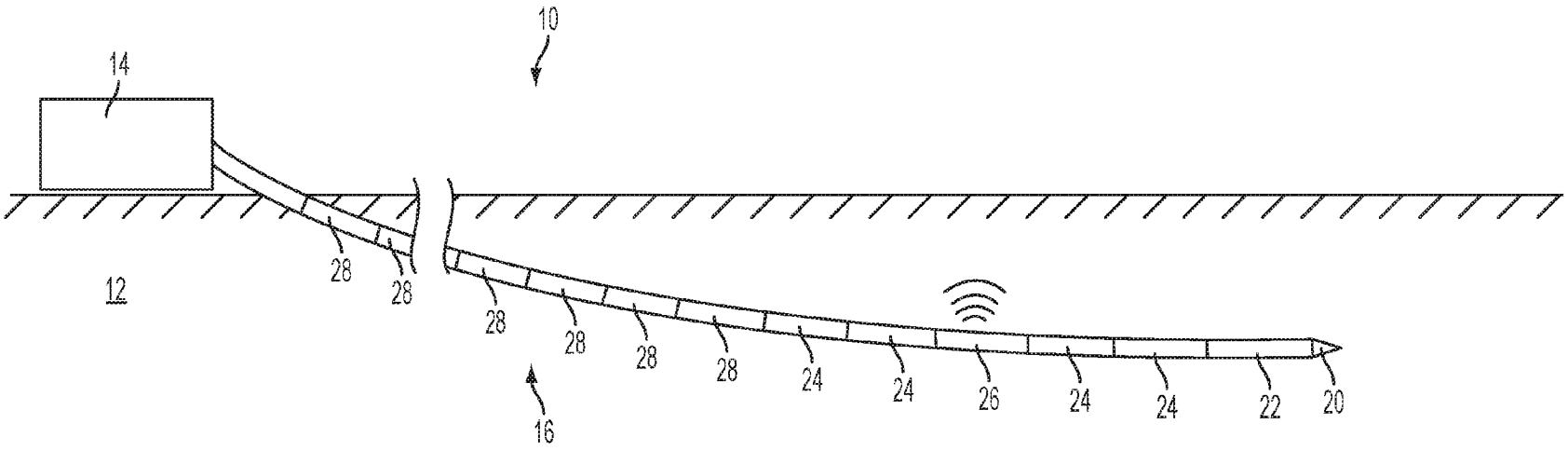
FIG. 1 is a cross-sectional view of an exemplary directional drilling system.

Disclosed herein are systems and methods for underground directional drilling. As used herein, the term "directional drilling" means the practice of drilling underground non-vertical bores. Directional drilling is often performed to create bores for the underground installation of utility conduits, such as for electrical power, communications, fluids, and other utility purposes. In some embodiments, direction drilling methods and systems disclosed herein are used to create underground bores having a first surface entry point and a second surface exit point, such as with a non-linear bore extending between the entry point and exit point. In some embodiments, non-vertical bores can be created having a surface entry point, but no surface exit, such as for accessing an underground target location.

Directional drilling bores often need to be made along non-linear paths. For example, a bore may need to extend under a river or road, around an obstacle, or along the contours of a certain geologic formation. Furthermore, the bore path often must meet certain limitations based on the intended use of the bore. For example, some power lines must remain at least a certain distance below the surface, and certain conduits cannot exceed certain bend curvatures. Laws and regulations can also affect the bore path.

In an exemplary method, a desired bore path is initially determined based on various parameters of the bore environment, the intended use of the bore, the available tools used to perform the drilling, and/or other factors. In some embodiments, a three-dimensional topographical mapping of the surface of the geologic environment of the bore can be made. GPS technologies and/or other surveying technologies can be used to generate such a topographical mapping of the surface. Mapping of underground geologic formations can also be determined, such as to locate undrillable or difficult to drill through underground regions, or to locate other obstacles, such as a previously existing bore or buried utility lines.

Based on the known characteristics of the boring environment, as well as other limitations based on the intended use of the bore, legal limitations, and the available boring equipment, etc., a desired underground bore path can be determined. The bore path can extend from an origination or entry point on the surface to an outlet or exit point on the surface. In other example, one end of the bore can be below ground. The determined bore path can include a three-dimensional path of the bore as well as the diameter of the bore and/or other variable features of the bore.

Any suitable software application(s) can be used to determine a desired bore path based on the given limitations. In some examples, a desired bore path can be determined to an accuracy of less than one centimeter. Once a three-dimensional desired bore path is determined, exact three-dimensional coordinate sets can be determined at a plurality of points along the bore path. These coordinate sets can be used during the boring process to compare the current location of a bore to the desired bore path, and can be used to direct the drilling apparatus along the desired bore path toward each subsequent coordinate set.

The coordinate sets and/or other data related to the desired bore path can be used in conjunction with actual drilling data received during the drilling process to guide and adjust the boring apparatus during drilling.

FIG. 1 shows an exemplary directional drilling system 10 inserted into a geologic formation 12. The drilling system 10 can comprise a drilling rig 14 located on the surface at a proximal end of a drilling string 16 that creates and extends through a bore in the geologic formation 12. The drilling string 16 can comprise a plurality of elongated segments having a generally circular cross-section of approximately the same diameter and coupled together end-to-end. The segments can comprise one or more of various different types of segments, including a drilling head 20 at a distal end of the drilling string 16.

The drilling string 16 further comprises additional segments that mechanically, fluidly, and or electrically couple the drilling rig 14 to the drilling head 20 to transfer power from a power source in the drilling rig to the drilling head, such that the drilling head can bore through the geologic formation distally along the predetermined or desired bore path. The number of segments along the drilling string 16 between the drilling rig 14 and the drilling head 20 varies throughout the drilling process. As the bore becomes longer, additional segments are added to the proximal end of the drilling string 16 adjacent to the drilling rig 14, and the existing segments are pushed distally through the bore.

The drilling string 16 can include a motor segment 22 at the distal end of the drilling string just behind the drilling head 20. The motor segment 22 is configured to transfer power from the drilling string into a form suitable for powering the drilling head 20. In some embodiments, the motor segment 22 can transfer rotational motion of the drilling string, fluid pressure within the drilling string, and/or electrical power, into a format for driving one or more drill bits or components of the drilling head 20. For example, a mechanical motor segment can be used in conjunction with a dual-shaft drilling string configuration described below, whereby one or both of an inner shaft or an outer shaft mechanically drives the motor segment. In some embodiments, the motor segment can comprise a mud motor or other fluidly driven motor.

Figure 2:
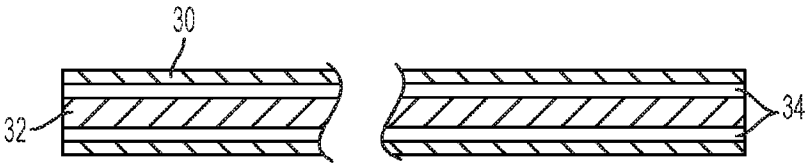
FIG. 2 is a cross-sectional view of an exemplary dual shaft drilling segment.

The drilling string 16 can comprise a dual-shaft configuration. As shown in FIGS. 1 and 2, each segment of the dual-shaft drill string (such as the segments 22, 24, 26, and 28 in system 10 of FIG. 1) can comprise an annular outer shaft 30 and an inner shaft 32 positioned within the outer shaft. The inner and outer shafts of each segment can be independently rotatable. The outer shaft 30 of the segments of the drilling string 16 are mechanically coupled to the outer shafts of the adjacent segments of the drilling string, such that the outer shafts are mechanically coupled together from motor segment 22 back to the drilling rig 14. Similarly, the inner shaft 32 of the segments of the drilling string 16 are mechanically coupled to the inner shafts of the adjacent segments of the drilling string, such that the inner shafts are mechanically coupled together from motor segment 22 back to the drilling rig 14. The drilling rig 14 can thereby transfer rotational power along the outer shafts 30 to the motor segment 22 and/or transfer rotational power along the inner shafts 30 to the motor segment.

In some embodiments, the motor segment 22 can be configured to use rotational power from rotation of the outer shafts 30 for one drilling purpose, and configured to use rotational power from rotation of the inner shafts 32 for another drilling purpose. For example, outer shaft rotation can be used for drilling through one type of geologic material, such as soft dirt, while the inner shaft rotation can be used for drilling through another type of geologic material, such as hard rock, and can also be used for steering. In some embodiments, the drilling string can comprise more than one drilling head and/or more than one motor for independently utilizing the inner and outer shaft rotations.

The dual-shaft segments along the drilling string 16 can include an annular pathway 34 between the inner shafts 32 and the outer shafts 30. In some embodiments, the inner shafts 32 can further comprises in internal lumen (not shown) providing another fluid pathway independent of the annular pathway 34. Furthermore, an outer annular region can exist between the outer surface of the outer shafts 30 and the bore itself, providing another independent fluid pathway through the bore. These fluid pathways can be used to conduct various fluids proximally and/or distally along the bore while the drilling string is in the bore, and while the drilling string is rotating in operation. In some embodiments, water, mud, or other drilling fluids can be pumped distally through the annular pathway 34 to drive the motor segment 22 and/or to flush out cut debris from the distal end of the bore. This fluid can also lubricate the system and/or cool the system. Used fluid, such as fluid containing cut bore material, can be conducted back proximally out of the bore along the external annular region between the outer shafts 30 and the bore walls. In some embodiments, one or more of the pathways along the drilling string can also be used to conduct wires, such for electrical power or communications.

The various segments of the drilling string 16 can comprise strong, durable materials in order to effectively transfer large axial and rotational forces along the drilling string. For example, some of the segments can be comprised of steel, stainless steel, titanium, aluminum, alloys, and/or other strong, durable materials. In some embodiments, materials can be selected based in part on magnetic properties, as described below.

The drilling string 16 can comprise at least one communication segment 26 that is configured to transmit drilling-related data from the underground drilling location to an above ground location. The communication segment 26 comprises a dual-shaft configuration like other segments in the drilling string 16, while also including additional components to carry out communications operations. The communication segment 26 can be located anywhere along the length of the drilling string 16, and is desirably located close to the drilling head 20 and motor segment 22. More than one communication segment 26 can be included in some drilling strings.

In some embodiments, as shown in FIG. 1, the communication segment 26 can be spaced proximally from the motor segment 22 by one or more other dual-shaft segments, such as non-magnetic dual-shaft segments. As used herein, the term "non-magnetic" means made primarily of substantially non-magnetic material, or material not substantially affected by magnetic fields, such as stainless steel and aluminum, as opposed to metals having a high ferrous content for example. In the example shown in FIG. 1, the communication segment 26 is spaced from the motor segment 22 by two non-magnetic dual-shaft segments 24, and also spaced from the more proximal dual-shaft segments 28 by two additional non-magnetic dual-shaft segments 24. The communication segment 26 can itself also be a non-magnetic dual-shaft segment.

The communication segment 26 can comprise one or more magnetism-sensitive devices, such as a compass or other sensor, the functioning of which requires isolation from substantial amounts materials that are not non-magnetic (e.g., materials with high ferrous content), such as the motor segment 22, the drilling head 20, and/or the proximal dual-shaft segments 28. Thus, by isolating the communication segment 26 via the non-magnetic dual-shaft segments 24 on either side, the one or more magnetism-sensitive devices in the communication segment 26 can function with no substantial interference from magnetic materials. Other than being made of non-magnetic material, the non-magnetic segments 24 can be similar to the proximal segments 28.

Figure 3:
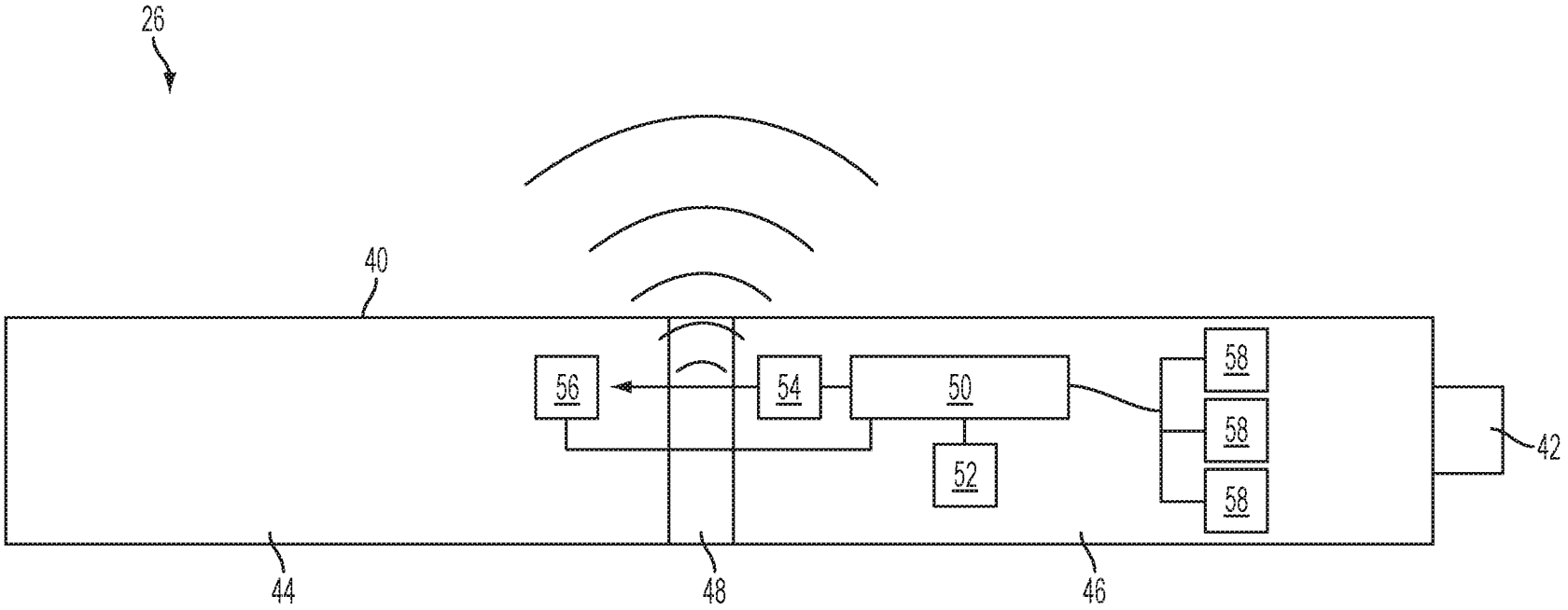
FIG. 3 is a schematic illustration of dual shaft drilling segment comprising a communication system.

A schematic illustration of an exemplary communication segment 26 is shown in FIG. 3. The communication segment 26 comprises an annular outer shaft 40 and an inner shaft 42 that extends through the outer shaft. The outer shaft 40 can comprise a first longitudinal portion 46, a second longitudinal portion 44, and a gap portion 48 between the first and second longitudinal portions 44, 46. The gap portion 48 can comprise material that provides electrical insulation between the first and second longitudinal portions.

The outer shaft 40 can further comprise a communication controller 50 that is electrically coupled to a first electrode 54 on one side of the gap portion 48 and electrically coupled to a second electrode 56 on the other side of the gap portion 48. In some embodiments, the communication controller 50 and the first electrode 54 can be positioned in the first longitudinal portion 46 of the outer shaft and the second electrode 56 can be positioned in the second longitudinal portion 44 of the outer shaft. The communication controller 50 is configured to generate a voltage difference between the first and second electrodes 54, 56 sufficient to cause an electrical pulse to transfer from one of the electrodes, through the gap portion 48, and to the other electrode. The communication controller 50 can generate a plurality of such electrical pulses and can modulate the frequency of the pulses to wirelessly communicate drilling related data from the underground drilling location to an above ground location. In some embodiments, the communication segment 26 can be configured to wirelessly transmit data to an above ground receiver that is located within a signal range. The signal range through earth can be up to about 15,000 feet from the communication segment. The vertical depth of the communication segment below the surface can be a critical distance, as the signals can travel much further through air once passing through the earth to the surface. In some embodiments, the generated electrical pulses from the communication segment are sufficient to communicate drilling-related data to an above ground receiver when the communication segment is located at a vertical depth below the surface of more than 100 feet, such as at least 150 feet, at least 200 feet, at least 500 feet, at least 1000 feet, at least 5000 feet, at least 10,000 feet, or at least 15,000 feet.

The wireless pulses can be detected or received at any above ground location within the signal range, whether directly above the communication segment or at any angle from vertical relative to the communication segment. Thus, a receiver or detector need not be located directly above the communication segment. This can be particularly advantageous in situations where the surface location above the communication segment is inaccessible, such is below a body of water, road, or building. Relays or similar devices can be used to extend the signal horizontally above ground, such as if the receiver is located long distances horizontally away from the communication segment.

In some embodiments, one or more relays or other signal transmission devices can be located within the signal range of the communication segment and can receive or detect the wireless pulse, and can relay the received data wirelessly to other relays and/or to a destination where the data can be uses, such as at the drilling rig or other relatively stationary location. Such signal transmission devices can be located at various surface locations along the region of the bore path and/or can be embedded in the ground at any depth to increase the wireless range of the communication segment. For example, a signal transmission device located 100 meters underground can allow data to be transmitted from the communication segment to an eventual above ground location from up to an additional 100 meters below the surface. Due to the wireless transmission of data from the communication segment to surface locations, the communication segment and/or other underground segments of the drilling string 16 do not need to include any wired connection to the surface. Wireless communication along the drilling string 16 can be particularly advantageous with a dual-shaft drilling string, there can be limited or no space along the drilling string to located wires, and because the inner shafts and outer shafts rotate independently of each other.

In some embodiments, the communication controller 50 can be configured to transmit data via the electrical pulses at certain times during the drilling process. For example, a first portion of the planned bore path can be drilled, and then the drilling process can be stopped to send and receive data from the communication segment underground. The communication segment can redundantly transmit the data any number of times, such as 6 or 7 times over a few seconds or minutes, to improve the accuracy of the data transmission. Once the drilling related data is received, the current characteristics of the drilling string and the completed portion of the bore can be compared to desired or planned characteristics of the bore or other threshold parameters, and based on the comparison, adjustments can be made to the drilling process if needed. For example, if it is determined that the drilling head is currently located a significant distance (such as about a centimeter or more) away from the desired bore path, the drilling head can be redirected to travel back toward the desired bore path, or a new bore path can be determined. The drilling related data can be transmitted from the communication segment while the drilling process is ongoing and/or when the drilling process is stopped. Furthermore, adjustments to the drilling process, such as changes in direction, can be made while the drilling process is ongoing and/or when the drilling process is stopped. Transmitting data from the communication segment and/or making adjustments while drilling is ongoing can reduce the time and cost of the drilling operation, and can increase the overall accuracy of the drilling process. Drilling data analysis and corresponding drilling adjustments can be performed at several intervals along a drilling operation from a bore entry point to a bore exit point or other bore terminus.

The communication segment 26 can further comprise one or more sensors, receivers, and/or other devices 58 configured to send data signals to the communication controller 50. The sensors 58 can detect and/or transmit various types of drilling related data, such as orientation data, pitch and yaw data, inclination and azimuth data, compass direction data, fluid pressure data, rotation speed data, torque and force data, vibration data, gamma ray data, temperature data, and/or other types of drilling-related data. The data from the sensors 58 can be processed by the communication controller and wirelessly transmitted using modulated pulses between the electrodes 54 and 56. Any one or more of the communication controller 50, the electrodes 54, 56, and the sensors 58 can be powered by a local power source 52, such as one or more batteries, included in the outer shaft 40. The controller 50, power source 52, and/or other electrical components can be housed in compartments in the outer shaft 40, such as the compartments 60 shown in the example of FIG. 4, and covered by protective covers. The electrical components can also be embedded in the outer shaft material itself.

In some embodiments, one or more sensors can be located in the motor segment 22. For example, a gyroscopic sensor can be included in the motor segment 22 to determine the orientation of the drill string at a location closer to the drill head 20 than the communication segment 26. This can help to more accurately determine the position and orientation of the drilling head 20 within the bore. The sensor(s) in the motor segment 22 can communicate data to the communication controller wirelessly (such as via RF signals) and/or through wired connections. In some embodiments, the communication segment 26 includes one or more RF receivers for wirelessly receiving RF signals from sensors in the motor segment 22 and/or from sensors in other segments of the drilling string 16. Received data can be sent to the communication controller for wireless transmission to an above-ground location or other remote location. The gyroscopic sensor can be used to determine orientation data when a magnetic compass-type sensor in the communication segment is not functional or otherwise impaired, such as when the communication segments is an area of relatively high magnetic disturbance (e.g., high ferrous content in the substrate, nearby power lines, etc.).

Figure 4:
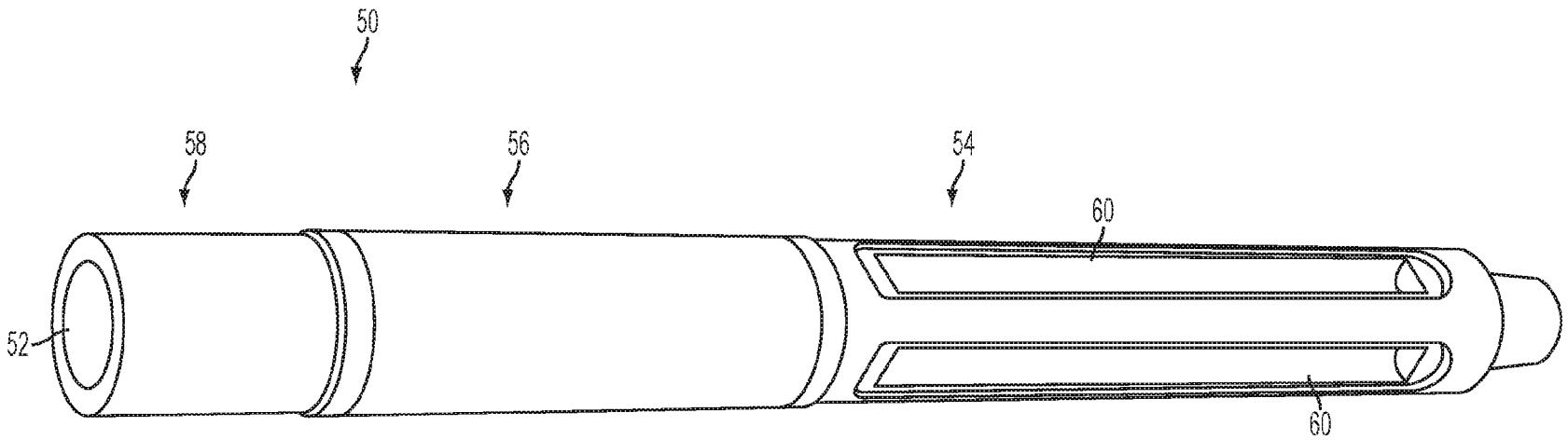
FIG. 4 is a perspective view of one exemplary embodiment of the dual shaft drilling segment of FIG. 3.

FIG. 4 shows an exemplary embodiment of an outer shaft 50 for a communication segment. The outer shaft 50 comprises an inner lumen 52, in which an inner shaft can be positioned. The outer shaft 50 further comprises a first longitudinal portion 54, a second longitudinal portion 58, and a gap portion 56 between the first and second longitudinal portions. The first longitudinal portion 54 comprises compartments 60 that are configured to house the communication controller and batteries. The compartments 60 can be enclosed by affixing external plates to seal the electrical devices within the compartments.

The gap portion can have varying lengths in a communication segment, such as from less than one inch to one foot or more, depending on many factors, such as the size of the drilling string, the depth of the bore, the type and power of the communication controller and electrodes, the material of the gap portion, characteristics of the geologic formations, etc. The material of the gap portion can include any suitable electrical insulating material, such as metallic, ceramic, polymeric, and/or other types of materials. The gap portion can have tapered end surfaces that mate with correspondingly shaped end surfaces of the first and second longitudinal portions, to provide an increased surface area for securing the gap portion to the first and second longitudinal end portions. Adhesives, welds, mechanical fasteners, and/or other means can be used to secure the gap portion and the first and second longitudinal portions together to form an outer shaft having sufficient strength and integrity to function in an underground drilling environment.

In some embodiments, liquid pulse telemetry can be used to transmit data from underground portions of the drill string to the surface. In liquid pulse telemetry, data is encoded (e.g., digitally) in pressure waves or pressure fluctuations in a fluid conducted along the drilling string. The fluid can comprise a functional drilling fluid, such as water or mud. In some embodiments, one or more valves and/or pumps along a fluid conduit (e.g., the annulus 34 between the inner and outer shafts) can be operated to create such pressure waves. The pressure waves can propagate within the fluid to the surface where they are received with pressure sensors, and the pressure signals can be processed to decode the drilling related data. Similarly, surface-to-downhole communications can also be transmitted using pressure waves in the fluid. Liquid pulse telemetry can be used in conjunction with and/or instead of other forms of wireless communications described herein to communicate data between an underground location and a surface location.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. Additionally, terms like "determine" and "provide" are sometimes used to describe the disclosed methods. These terms are high-level abstractions of the actual operations that are performed. The actual operations that correspond to these terms may vary depending on the particular implementation and are readily discernible by one of ordinary skill in the art.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means physically or electrically coupled or linked and does not exclude the presence of intermediate elements between the coupled or associated items absent specific contrary language.

Unless otherwise indicated, all numbers expressing properties, sizes, percentages, measurements, distances, ratios, and so forth, as used in the specification or claims are to be understood as being modified by the term "about." Accordingly, unless otherwise indicated, implicitly or explicitly, the numerical parameters set forth are approximations that may depend on the desired properties sought and/or limits of detection under standard test conditions/methods. When directly and explicitly distinguishing embodiments from discussed prior art, numbers are not approximations unless the word "about" is recited.

In view of the many possible embodiments to which the disclosed principles may be applied, it should be recognized that the illustrated embodiments are only preferred examples and should not be taken as limiting the scope of the disclosure. Rather, the scope of the disclosure is at least as broad as the scope of the following claims. We therefore claim all that comes within the scope of these claims.

The invention claimed is:

1. An underground directional drilling system comprising:

a plurality of dual-shaft segments coupled together end-to-end in a drilling string, each of the plurality of dual-shaft segments comprising an inner shaft and an annular outer shaft positioned around the inner shaft, the inner shafts being coupled together to transfer drilling forces along the drilling string from a proximal source to a distal drilling location, and the outer shafts being coupled together to transfer drilling forces along the drilling string from a proximal source to a distal drilling location;

the plurality of dual-shaft segments comprising a communication segment that comprises an inner shaft portion and an inner shaft portion, wherein the outer shaft portion includes a first electrode, a second electrode, a gap portion between the first and second electrodes that provides electrical insulation between the first and second electrodes, and an electronic communication controller electrically coupled to the first and second electrodes;

wherein the electronic communication controller is configured to generate voltage differences between the first and second electrodes that cause electrical pulses to transfer from one of the first and second electrodes, through the gap portion, and to the other of the first and second electrodes, without the inner shaft portion forming an electrical connection between the first and second electrodes, to wirelessly communicate drilling related data from an underground location to an above ground location.

2. The drilling system of claim 1, wherein the inner shaft portion and the outer shaft portion of the communication segment comprise non-magnetic material.

3. The drilling system of claim 2, wherein the plurality of dual-shaft segments further comprises at least one non-magnetic dual-shaft segment attached to a proximal end of the communication segment and at least one non-magnetic dual-shaft segment attached to a distal end of the communication segment.

4. The drilling system of claim 2, wherein the plurality of dual-shaft segments further comprises a group of two non-magnetic dual-shaft segments attached to a proximal end of the communication segment and a group of two non-magnetic dual-shaft segment attached to a distal end of the communication segment.

5. The drilling system of claim 1, further comprising a motor segment positioned distal to the communication segment, and wherein the motor segment comprises a gyroscopic sensor configured to transmit orientation data to the communication segment for wireless transmission to a surface location via the electrical pulses.

6. The drilling system of claim 3, wherein the communication segment further comprises a magnetic compass sensor configured to transmit orientation data to the communication controller for wireless communication to a surface location via the electrical pulses.

7. The drilling system of claim 1, wherein the outer shaft portion of the communication segment comprises external compartments.

8. The drilling system of claim 7, wherein the external compartments house the electronic communication controller.

9. The drilling system of claim 7, wherein the external compartments house a battery that supplies power to the electronic communication controller.

10. The drilling system of claim 7, wherein the external compartments are enclosed by external plates that seal electrical devices within the compartments.

11. The drilling system of claim 1, wherein the outer shafts of the plurality of dual-shaft segments are rotatable independently of the inner shafts of the plurality of dual-shaft segments.

12. A method for directional drilling comprising:

causing a dual-shaft directional drilling system to drill a first portion of a bore along a first portion of a predetermined bore path that extends through a geologic formation from a bore entry point at a first surface location to a bore exit point at a second surface location;

after the first portion of the bore is drilled, causing a dual-shaft communication segment of the dual-shaft directional drilling system to generate electrical pulses across an electrical insulator at a modulated frequency, without an inner shaft portion of the communication segment forming an electrical connection that bypasses the insulator, to wirelessly transmit drilling-related data from an underground location to an above ground location; and causing an adjustment of at least one drilling-related parameter of the dual-shaft directional drilling system based on the received drilling-related data prior to or while drilling a second portion of the bore along a second portion of the determined bore path.

13. The method of claim 12, wherein the causing the dual-shaft communication segment of the dual-shaft directional drilling system to generate electrical pulses across the electrical insulator comprises causing a sufficient voltage difference to be created between a first electrode located on a first side of the electrical insulator and a second electrode located on a second side of the electrical insulator such that an electrical pulse discharges between the electrodes across the insulator, and modulating the frequency of the pulses to digitally encode drilling related data.

14. The method of claim 12, wherein the drilling-related data comprises pitch and yaw data, and wherein the causing an adjustment of at least one drilling-related parameter of the dual-shaft directional drilling system comprises causing an adjustment of a drilling direction of the dual-shaft directional drilling system based on the pitch and yaw data.

15. The method of claim 14, further comprising causing a wireless communication of the pitch and yaw data from a sensor in a motor segment of the dual-shaft directional drilling system to the communication segment, the motor segment being distal to and spaced from the communication segment.

16. The method of claim 12, further comprising communicating data from an underground portion of the dual-shaft directional drilling system to a surface location using fluid pulse telemetry, wherein pressure fluctuations are modulated in a fluid located in an annular region between inner shafts and outer shafts of the dual-shaft directional drilling system.

* * * * *